US005094023A

United States Patent [19]

McVey

[11] Patent Number: 5,094,023

[45] Date of Patent: Mar. 10, 1992

[54] ROADWAY SAFETY SIGN STAND APPARATUS

[75] Inventor: Michael T. McVey, Pierce, Colo.

[73] Assignee: Meadowlark Manufacturing, Inc., Pierce, Colo.

[21] Appl. No.: 581,743

[22] Filed: Sep. 13, 1990

[51] Int. Cl.[5] ..... G09F 15/00

[52] U.S. Cl. ..... 40/606; 40/607; 40/610; 248/188.5

[58] Field of Search ..... 40/606, 607, 610, 612; 248/455, 465, 170, 188.5; 116/63 P, 173

[56] References Cited

U.S. PATENT DOCUMENTS

| | | | |
|---|---|---|---|
| D. 285,220 | 9/1986 | Cooper et al. | D20/42 |
| 1,649,249 | 11/1927 | Newman | 40/606 |
| 2,849,202 | 8/1958 | McCombs | 248/188.5 X |
| 3,165,847 | 1/1965 | Gunderson | 40/610 |
| 3,200,786 | 8/1965 | Swezy et al. | 116/63 P |
| 3,287,840 | 11/1966 | Keats | 40/613 |
| 3,519,235 | 7/1970 | Walter | 248/166 |
| 3,526,200 | 9/1970 | Doyle | 116/63 P |
| 3,591,116 | 7/1971 | Dalum | 248/166 |
| 3,620,496 | 11/1971 | Bolt et al. | 248/171 |
| 3,664,618 | 5/1972 | Krueger | 248/519 |
| 3,828,455 | 8/1974 | Bentley | 40/602 |
| 3,899,843 | 8/1975 | Doyle | 40/602 |
| 4,019,271 | 4/1977 | Latimer | 40/603 |
| 4,071,970 | 2/1978 | Strizki | 40/607 |
| 4,092,792 | 6/1978 | Vorhees | 40/607 |
| 4,096,662 | 6/1978 | Anderson | 248/170 X |
| 4,310,979 | 1/1982 | Bloom | 40/607 |
| 4,411,085 | 10/1983 | Farmer | 40/610 |
| 4,426,800 | 1/1984 | Brown | 40/606 |
| 4,490,934 | 1/1985 | Knapp | 40/603 |
| 4,498,657 | 2/1985 | Werner | 248/623 |
| 4,507,887 | 4/1985 | Seely | 40/606 |
| 4,592,158 | 6/1986 | Seely | 40/603 |
| 4,658,527 | 4/1987 | Pingel | 40/606 |
| 4,676,015 | 6/1987 | Stoudt | 40/608 |
| 4,694,601 | 9/1987 | Dicke et al. | 40/610 |
| 4,698,928 | 10/1987 | Soporowski | 40/651 |
| 4,714,220 | 12/1987 | Hillstrom | 248/160 |
| 4,717,110 | 1/1988 | Fohrman | 248/545 |
| 4,790,092 | 12/1988 | Farmer | 40/607 |
| 4,817,318 | 4/1989 | Strauch | 40/610 |
| 4,882,866 | 11/1989 | Gebhardt | 40/611 |
| 4,888,894 | 12/1989 | Brown | 40/606 |
| 4,905,391 | 3/1990 | Dillon | 40/610 |

OTHER PUBLICATIONS

Telespar catalog, 1963, p. 11.

Title and Author: American Traffic Safety Services Association, 1989, pp. 1–84.

The One Source for Signs & Safety Equipment, Author: Eastern Metal of Elmira, Inc., Sep. 1, 1986, pp. 12–23.

*Primary Examiner*—Kenneth J. Dorner

*Assistant Examiner*—J. Bonifanti

*Attorney, Agent, or Firm*—Luke Santangelo

[57] ABSTRACT

A portable, temporary roadway sign stand (10) with a single upright support (11), a first stabilizing means (12), and a horizontal stabilizing means (13), all of which are telescopically extensible to allow for a great range of adjustable features. Such features include, but are not limited to, improved stability, quick and easy assembly and disassembly, compaction, and variable sign display height. Other constituents of sign stand (10) provide essential wind rigidity, adjustment for various sign types and sizes, conformity to uneven, irregular and/or sloping terrains, and break-away joints for safety purposes. The present invention is also designed to conform to federal, state, and local regulations, as well as the "standards of operation and use" established by other groups.

27 Claims, 7 Drawing Sheets

ROADWAY SAFETY SIGN STAND APPARATUS

I. BACKGROUND OF THE INVENTION

The present invention relates to the field of temporary roadway sign stand devices. More specifically it relates to temporary roadway sign stand devices for positioning on irregular or sloping terrain.

There are literally millions of miles of highways and roadways crisscrossing the United States. And as any motorist might attest, there seems to be a never-ending need to build more roads or repair existing ones. Such constant road work is cause for concern if the area under construction is improperly marked for upcoming traffic. For this reason temporary roadway warning signs play a particularly important role in highway traffic safety, and it is extremely desirable that these signs are erected and remain in a manner which is readable to passing traffic, at all times and under most all conditions.

The nature of this field has been established by incremental improvements of numerous known features by those skilled in the relevant art. Generally temporary signs are designed to be easily assembled, moved about, disassembled, and transported by small road crews or sometimes by just a single person, such as the device shown in U.S. Pat. No. 4411085 to Farmer. It is also preferable that the display height of the sign should be adjustable, as shown in U.S. Pat. No. 4092792 to Vorhees. A temporary sign stand should also possess an adjustable means to accommodate different sign types and sizes. This feature is shown in U.S. Pat. Nos. 4882866 to Gebhardt, and 4717110 to Fohrman. Another desirable feature in temporary sign stands is the ability to stand upright on uneven or irregular terrain, as disclosed in the Dillon reference, and in U.S. Pat. No. 4888894 to Brown, Jr. Dillon uses a tripod base to overcome the problems presented by these rocky and rough surfaces, while Brown, Jr. offers four legs which are individually extendable to adapt to these surfaces as well. Other modest improvements to temporary sign stands are shown in U.S. Pat. Nos. 4817318 to Strauch; 4714220 to Hillstrom, et al.; 4694601 to Dicke, et al.; 4676015 to Stoudt; 4658527 to Pingel; 4507887 to Seely; 4498657 to Werner; 4310979 to Bloom; 4019271 to Latimer; 3899843 to Doyle, et al.; 3828455 to Bentley; 3620496 to Bolt, et al.; 3591116 to Dalum; 3519235 to Walter; and 3165847 to Gunderson.

Despite the seemingly large number of patents which may relate to this field, until the present invention there has remained the problem of unreadable traffic warning signs. The causes of this problem may be categorized in a number of ways, including those which relate to the placement of the temporary sign stand—where and how it is erected for display to traffic—and to the design of the sign stand—wind resistivity, stabilization, etc.

The first facet of unreadable signs which is addressed by the present invention involves sign placement. One of the specific causes which typically results in an unreadable roadway sign is due to temporary sign stands being erected on sloping terrain—which is distinguishable from uneven or irregular terrain. The sign will typically lean in the same direction of the slope and is usually easily knocked over by a cross wind or pulled to the ground by gravity. Even if it remains standing the angle at which the sign is presented to traffic may minimize its communication effectiveness. Occasionally this may be rectified by moving the sign to another, more level, location. In some areas the angled terrain of a "barrow pit" running parallel to the roadway cannot be avoided without positioning the sign very close to or on the roadway. Common sense dictates that this would not be proper because the sign stand might present a greater hazard than it prevents. The present invention, unlike any of the prior art, is designed to adjust to this incline and display the sign in a readable manner.

Although no prior art has been found which completely addresses this problem in the manner in which the present invention does, solutions have been sought. For example, the Pingel reference shows a design which will stand upright on a sloping terrain by varying the depths to which each leg support is inserted into the ground. Soft ground is not always available, however, and the Pingel sign stand would then be useless in situations of hard or rocky ground or roadway. There are also a number of patents for tripod type sign stands, for instance U.S. Pat. No. 4905391 to Dillon, and "quadruped" type signs, such as that shown in the Brown, Jr. reference, which address the problem of using temporary roadway signs on uneven or irregular surfaces—those containing rocks, holes and generally rough terrain—but not for sloping terrain, which may be just as prevalent along roadways. The present invention addresses these concerns in a manner that allows for sloping terrain as well.

Another specific cause of temporary road signs being unreadable is high wind conditions, which often exist on open roadways. The vacuum created by large trucks as they pass temporary roadway signs may also create this same effect. That is, temporary roadway sign stands of a design as shown in the Stoudt reference may bend backwards, or, as shown in the Seely reference, may twist or flap side-to-side thereby distorting the viewable message on the sign. In fact, it has been the focus of a number of references to allow such movement to spill the wind and effectively prevent the tipping of the apparatus. The present invention takes a different approach by rigidly resisting these forces, rather than accommodating them. This insures the readability and permanence of the temporary warning sign at all times.

While the basis of the present invention could be considered to be relatively fundamental, it is a fact that those skilled in the relevant art failed to realize the proper combination and selection of elements to solve the prior problems. Although the implementing arts and elements of the present invention were available, those in the field focusing on the problems of a proper temporary sign stand had not been able to solve these problems. Others skilled in the relevant art took the direction and focus of designing signs, and sign stands to accommodate the prevailing winds in a manner so as to avoid upending. This resulted in those skilled in the art teaching away from the direction of the present invention. While there had been substantial attempts by those skilled in the art at overcoming the problem of unstable sign stands, until the present invention such attempts had not resulted in an adequate economical solution to the problem.

Those skilled in the relevant art had possibly misidentified the problem of unreadable signs in roadway traffic as strictly a problem of signs tipping over. The present invention has viewed this as just one of the many causes to the underlying problem. The invention of this application addresses the problem of unreadable roadway signs, and has appropriately identified a variety of factors such as upending, twisting, improper placement and such, as the causes.

II. SUMMARY OF THE INVENTION

Generally, the goals of the present invention are to provide a device which allows for the safe and reliable display of a roadway safety sign.

It is broadly an object of the present invention to provide a design which serves to utilize a rotatable base and a telescopically extensible stabilizer to enable a sign to be displayed effectively from off a roadway. It is therefore an object of the present invention to provide a design which can accommodate an irregular, uneven, or sloping terrain while displaying a sign in a readable position.

It is further an object of the present invention to provide a design which can operate in close proximity to a roadway, while remaining entirely off of the roadway. It is also an object of the present invention to provide a design which can operate on a roadway if necessary.

It is further an object of the present invention to provide a design which rigidly resists the forces exerted by a naturally occurring wind or by air currents created by passing traffic without having to relocate or reposition the sign stand. It is also an object of the present invention to provide a design which allows for increased stabilization in the direction of a strong wind or current.

It is further an object of the present invention to provide a design which avoids depression damage to new or hot surfaces when placed on said surface by distributing the weight of the sign stand. It is also an object of the present invention to provide a design which allows for the anchoring of the apparatus by sandbags or weights, as possibly required by law.

It is further an object of the present invention to provide a design which allows for convenient compaction of the sign stand for transportation and storage purposes by folding and disassembling the apparatus. It is also an object of the present invention to provide a design which allows for easy assemblage of the sign stand by a single person or a small crew of workers. Another object of the present invention is to provide a design which will deplete the number of road crew injuries in general, and specifically those injuries precipitated by erecting temporary roadway sign stands.

Naturally, further objects of the present invention are disclosed throughout other areas of the specification and claims.

III. BRIEF DESCRIPTION OF THE DRAWINGS

Figure 4A:
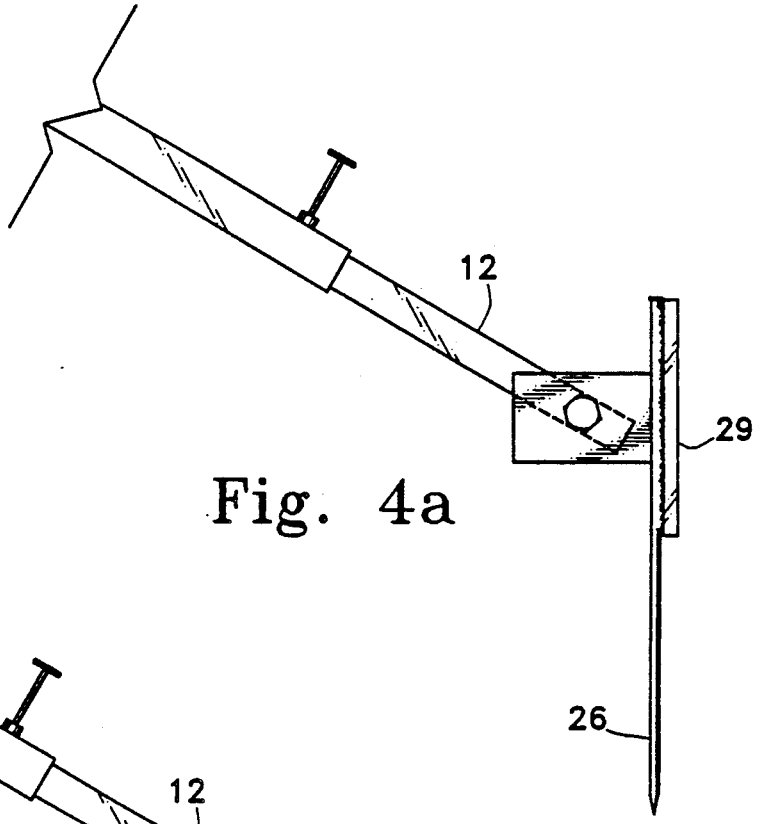
Figure 4B:
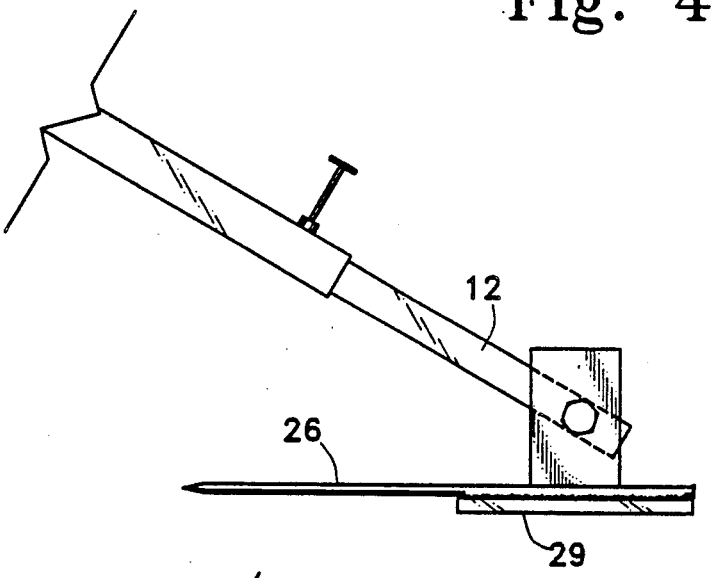
Figure 4C:
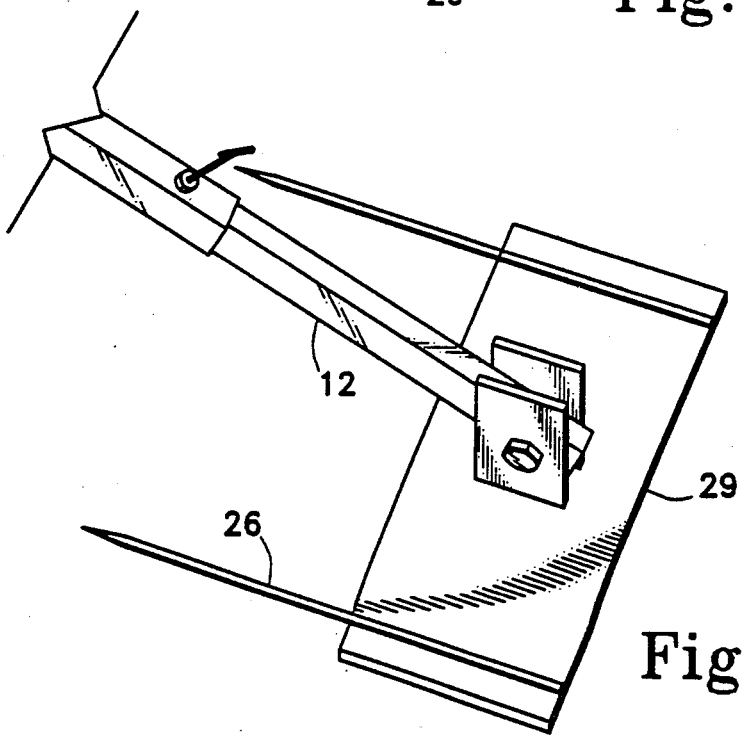

FIGS. 4*a–c* are a top and side views of the dual purpose rear footpad.

Figure 5:
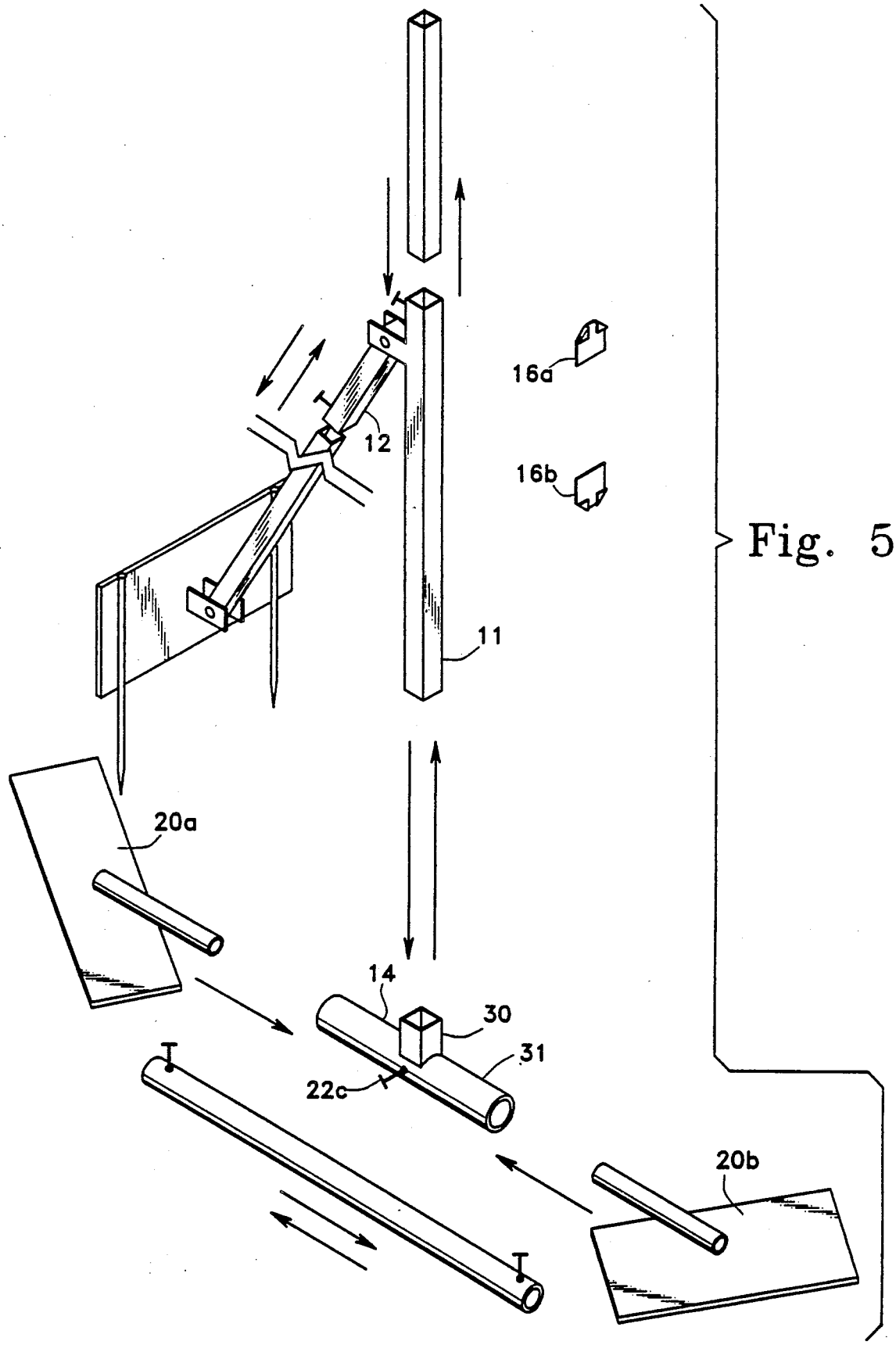

FIG. 5 is a disassembled front view of the sign stand apparatus with arrows indicating the telescoping aspects of the base and upright support.

Figure 6:
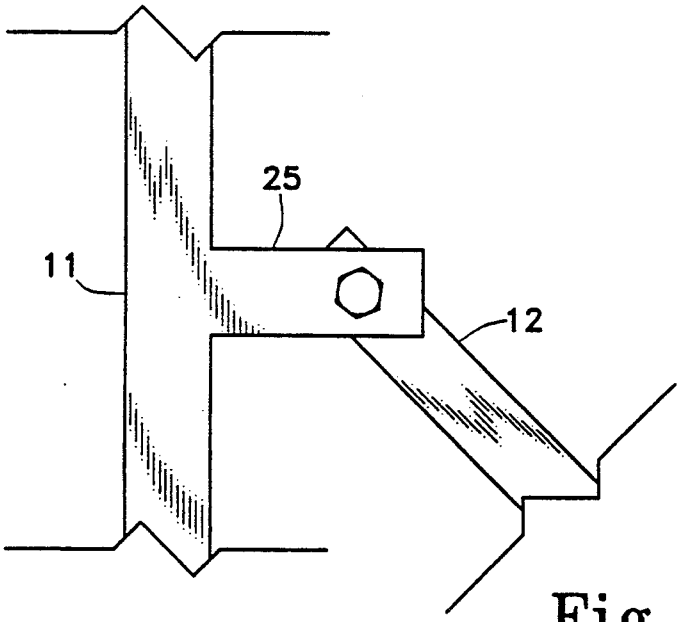

FIG. 6 is a side view of the wide hinge connecting the first stabilizing means to the upright support.

Figure 7:
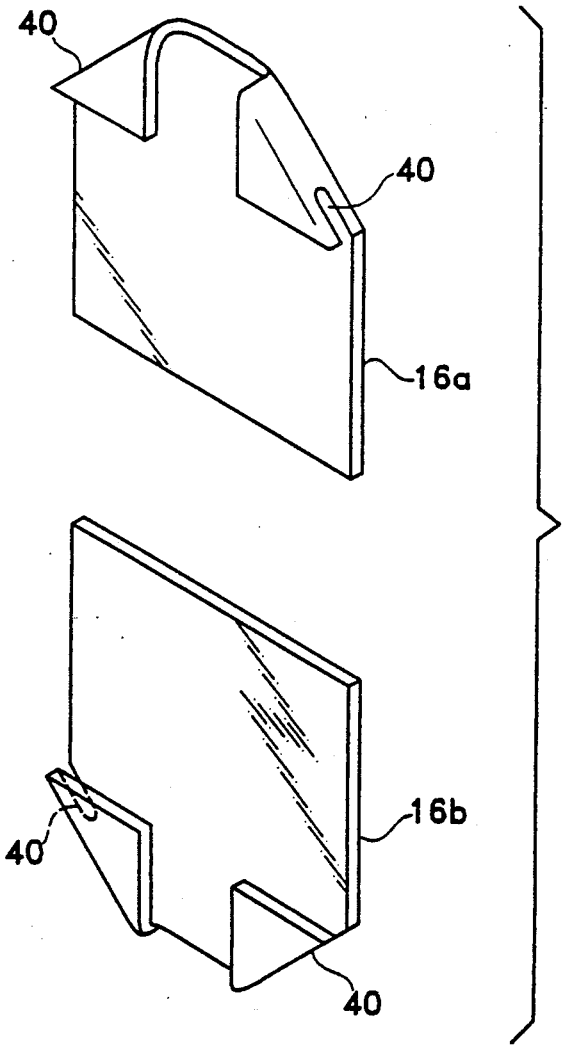

FIG. 7 is a perspective view of the sign engaging pockets.

Figure 1:
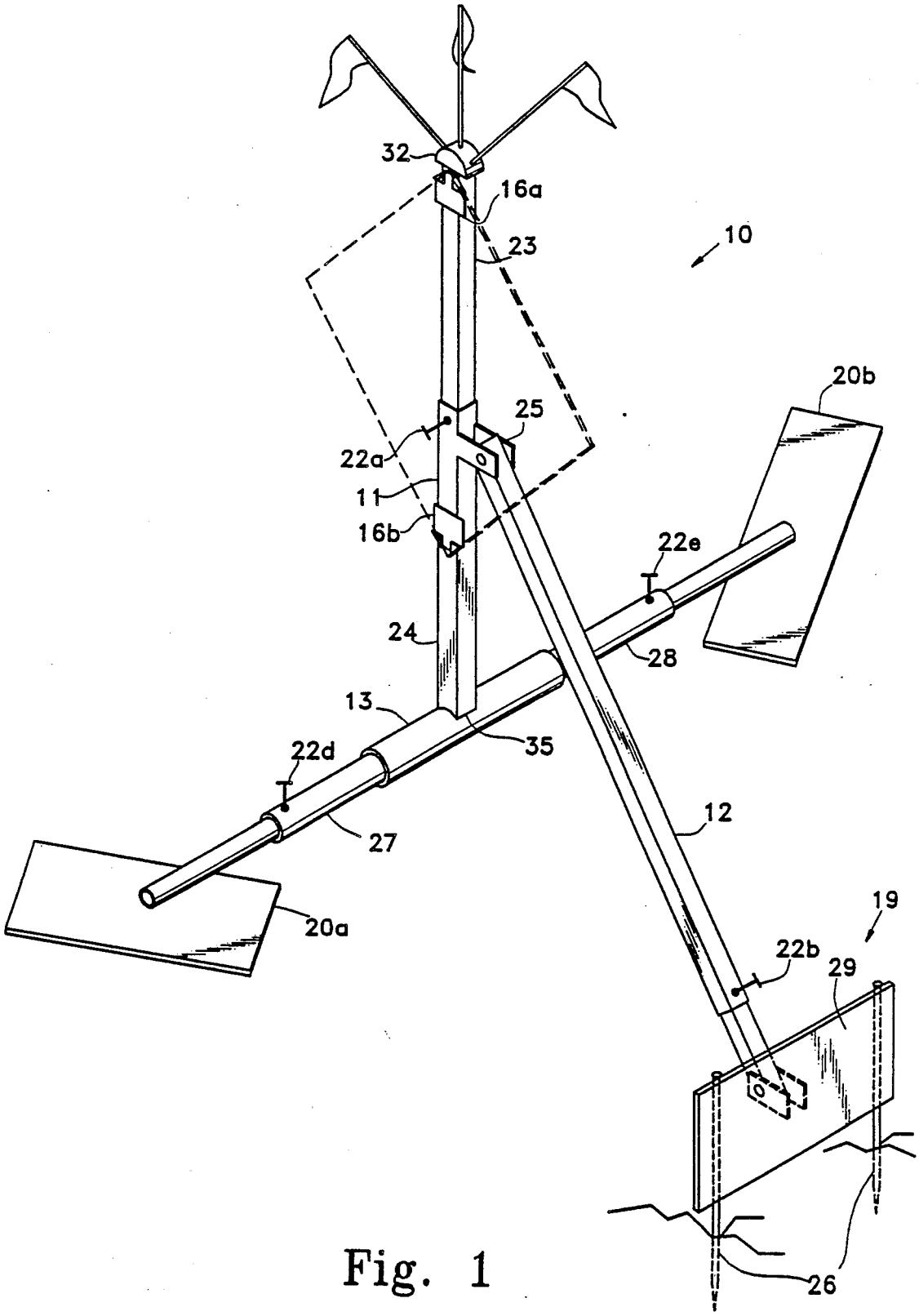
FIG. 1 is a perspective view of the sign stand apparatus, in a preferred embodiment, on a sloping terrain, and including a displayed warning sign and a 3-flag warning system.
Figure 8:
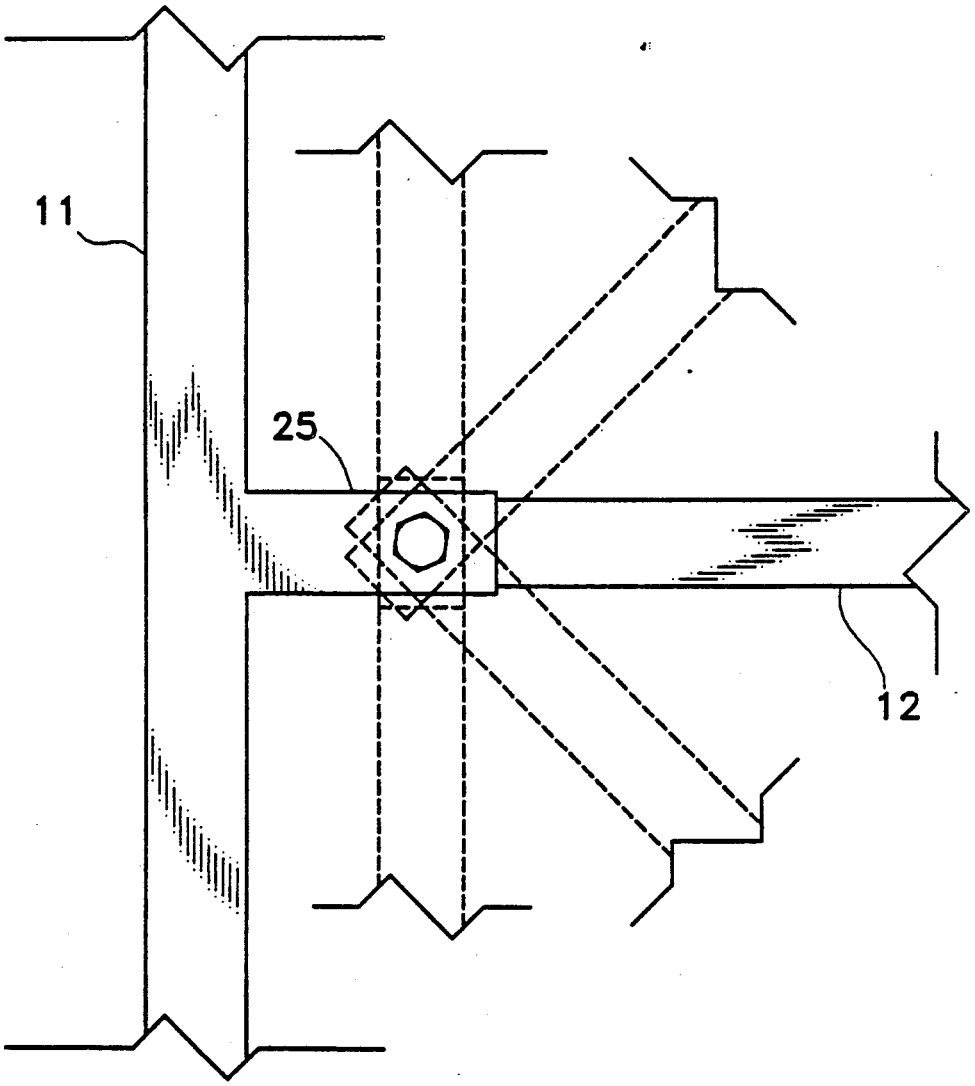

FIG. 8 is a side view of the embodiment shown in FIG. 1 showing the range of motion of first stabilizing means.

IV. DESCRIPTION OF PREFERRED EMBODIMENTS

As can been seen from the various drawings, the basic concepts of the present invention involve several different aspects. In all views the number 10 indicates the entire roadway sign stand apparatus, in any of its different embodiments. In the following text and claims the term "roadway" is intended to include highways, rural roads, suburban streets, boulevards, dirt roads, tollways, expressways, and any other paved or unpaved routes used for motorized or pedestrian travel. The term "safety sign" refers to signs used to convey a message of warning, road conditions, detours, hazards, or even simply general information.

Figure 2:
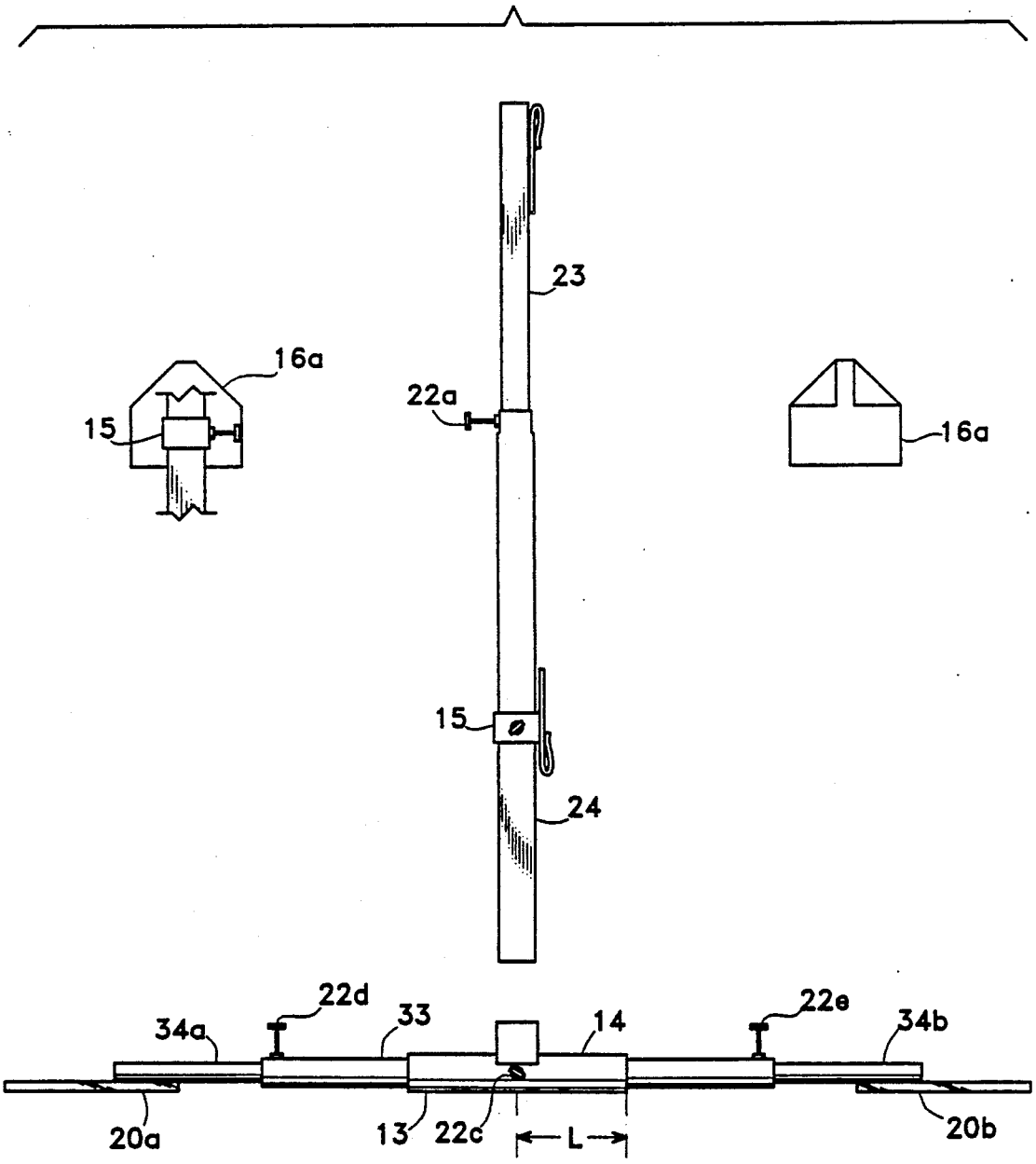
FIG. 2 is a side view of the embodiment shown in FIG. 1, without the sign or 3-flag warning system.

Referring first to FIGS. 1 and 2, most of the general design features can be seen, with identical numbers indicating similar elements in the different views. Single upright support (11) may be divided into two functionally distinct sections, upper section (23) and lower section (24). Connected to upper section (23) is hinge (25). The point at which hinge (25) is connected to upright support (11) may vary widely. Also attached to upper section (23) is upper and lower sign engaging pockets (16*a* and 16*b*, respectively). Adjacent to upright support (11) and attached to hinge (25) is first stabilizing means (12). First stabilizing means (12) is preferably telescopically extensible as it serves to retain upright support (11) in a vertical manner so as to allow a sign positioned on sign stand (10) to be readable at all times. By "telescopically extensible" it is meant that the device can be extended to a distance, and retracted thereafter. This is not limited to devices which extend from within each other, and it is certainly not limited to circular cross-sectional tubes. For instance, the device may extend and retract with adjacent components with a triangular or square cross-section. Certainly other possibilities exist. Opposite the hinged end of stabilizing means (12) is attached footpad (29) with integral spikes (26).

Returning to upright support (11) it can be seen to include lower section (24), to which is attached horizontal stabilizing means (13). Horizontal stabilizing means (13) consists of left portion (27) and right portion (28), each of which is preferably independently telescopically extensible. Each portion is also shown to have footpads (20*a* and 20*b*) attached to their "free" ends.

Having now discussed the three basic elements—upright (11), first stabilizing means (12), and horizontal stabilizing means (13)—and their constituents, the remaining text shall focus on specific details of each and their novel functions. Beginning again with upright support (11), it can be seen in FIG. 2 to be two rigid vertical tubes, preferably square in cross-section, inserted one into the other. Unlike round tubes, this arrangement will resist an rotational forces exerted on it without separate anti-rotation means such as pins, pegs or locking collars. Such rotational forces may be caused by, among other things, the wind, or currents resulting from passing traffic. The square cross-section also allows sign stand (10) to operate in two distinct modes as shown in FIGS. 1 and 4. The first mode, shown in FIG. 1, is operable close to roadway traffic, but remains entirely off of the roadway. A second mode, shown in FIG. 3, operates, for instance, to block traffic when a road is closed. Other advantages and uses of these two modes will be made more apparent later in this text.

Figure 3:
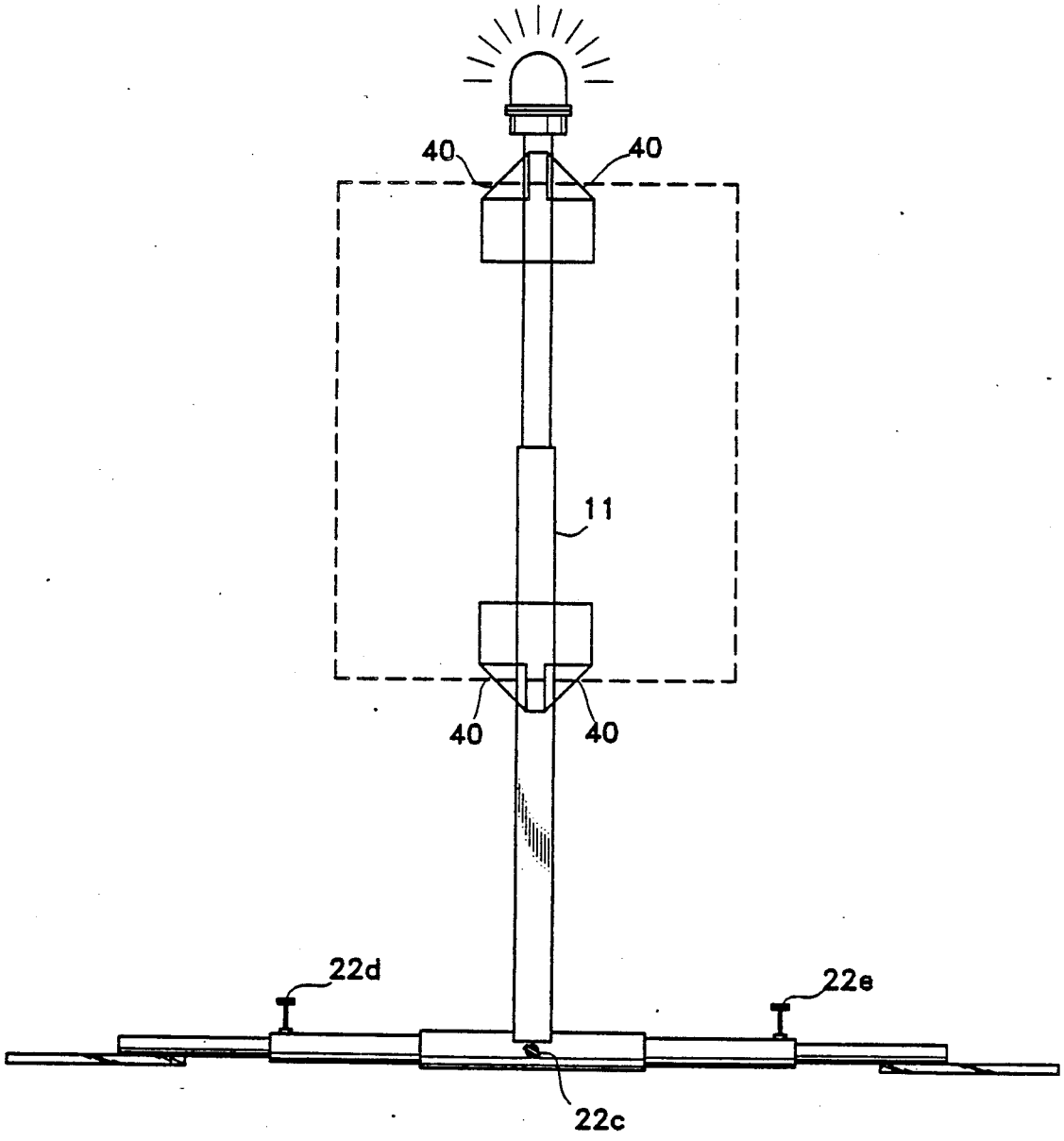
FIG. 3 is a perspective view of the sign stand apparatus, in a preferred embodiment, assembled in a second mode of operation, and including a displayed sign and warning light system.

A preferred design feature of the present invention is having upper portion (23) telescopically extensible from lower portion (24) to allow for a number of desirable adjustments. Working in conjunction with upper portion (23) and lower portion (24) are sign engaging pockets (16*a* and 16*b*). These pockets are designed to engage and hold the appropriate safety sign on sign stand (10) in a readable position and may include notches (40) as shown in FIGS. 3 and 7. It is desirable that the mounted safety sign be readable at all times while standing by the targeted traffic, either motorized, pedestrian or both. In the embodiment shown in FIG. 2 it can be seen that sign engaging pocket (16*a*) is preferably securely mounted to upper portion (23), while the other sign engaging pocket (16*b*) is mounted on slidable collar (15) which is positioned onto lower portion (24). This arrangement allows adjustments to be made to accommodate various sign sizes as well as the sign display height. The size adjustments can be made by vertically moving upper portion (23) or slidable collar (15), while the height adjustments can be made similarly by vertically moving upper portion (23) and slidable collar (15). In order to hold upper portion (23) at its desired height, locking mechanism (22*a*) is provided. This mechanism may be any of the enumerable apparatus available as prior art such as set screws and the like.

Referring now to FIG. 1, first stabilizing means (12) may be further explained and understood. First stabilizing means (12), like upright support (11), is telescopically extensible and provided with a similar locking mechanism (22*b*). This extensible feature allows considerable stabilization of sign stand (10) when mounted on a sloping terrain, such as that often associated with off-road use. Hinge (25) attaching first stabilizing means (12) to upright support (11) serves to extend the range of motion of stabilizing means (12), as shown in FIG. 8. For instance, on roadways which traverse mountainous terrain often little off-road space is available for temporary warning signs, especially those with large bases. Hinge (25) allows stabilizing means (12) to be raised to a position parallel or nearly parallel with the base surface, as displayed in FIG. 8. At this point anchoring means (19) may be secured to the base surface by inserting integral spikes (26). Anchoring means (19) has a dual function base for both weight and spike attachments, as shown in FIG. 4. Footpad (29) may be positioned flatly onto a base surface and sufficiently sandbagged (or weighted) as may be required by law. This broad surface area of footpad (29) allows improved distribution of weight on the base surface to aid in preventing depression damage to new or hot surfaces. The size and shape of footpad (29) should be based on how heavy sign stand (10) is, and the softness of the base surface. Alternately, as previously mentioned, integral spikes (26) may be inserted into the base surface to properly secure sign stand (10). To allow for this mode change anchoring means (19) is preferably hinged, as further shown in FIG. 4, but many variations are possible which would accommodate this feature.

Although hinge (25) offers a distinct advantage over alternate designs, it is still considered within the scope of the present invention to mount first stabilizing means (12) directly to upright support (11) either detachably, rotatably or permanently. The desired connection point may vary as well with respect to its vertical position on upright support (11). In the embodiment of FIG. 2 the connection point is shown to be in proximity to the uppermost point of lower portion (24).

A third general feature of the present invention is horizontal stabilizing means (13). Referring to FIG. 5, horizontal stabilizing means (13) can be more easily understood. It is preferable, in this embodiment, that horizontal stabilizing means (13) be rotatably mounted at the bottom of upright support (11). This is preferably accomplished by T-tube (14) having the vertical section (30) attached, releasably or permanently, to upright support (11), while the hollow horizontal section (31) retains horizontal stabilizing means (13). In order for rotation to occur freely the cross-section of horizontal stabilizing means (13) and horizontal section (31) should be circular. Once in position locking mechanism (22*c*) is provided which prohibits any further rotation. Horizontal stabilizing means (13) is divided into left portion (27) and right portion (28) which ar preferably independently telescopically extensible as shown in FIG. 1. Each portion may be extended a certain percentage of its original length (L), as shown in FIG. 2, without affecting the other portion. Once extended to the desired length each end may be locked into position by locking mechanism (22*d* and 22*e*). Telescoping horizontal stabilizing means (13) is characterized by a single primary tube (33), which extends in both directions (left and right) from T-tube (14), and two smaller secondary tubes (34*a* and 34*b*) extending from each end of primary tube (33). In this embodiment the percentage of total extensibility of either left portion (27) or right portion (28) is in the range of about 0–400% of their original length (L). At 0% of original length (L), primary tube (33) and secondary tube (34*a* or 34*b*) would be fully retracted or removed to leave only original length (L). Of course, any number of telescoping tube sections may be added to increase the total extensible range. Likewise, a single tube such as primary tube (33) may be used as horizontal stabilizing means (13). This extensibility feature allows adjustments to be made to provide greater stability of sign stand (10) in strong winds without having to relocate or reposition the entire apparatus. At the "free" end of each secondary tube (34*a* and 34*b*) footpads (20*a* and 20*b*) are preferably attached. The purposes of footpads (20*a* and 20*b*) are similar to that of footpad (29) on first stabilizing means (12)—even distribution of weight to avoid depression damage to roadway, and providing a place to apply sandbags (or weights) as may be required by law. Because footpads (20*a* and 20*b*) are mounted on rotatable tubes they can be configured to conform to the slope of the base surface. Additionally, since these tubes are independent of each other, each footpad (20*a* and 20*b*) can conform independently for irregular terrains. By "irregular" it is meant a surface with a generally rough exterior as a result of rocks, holes, or the like. Again, other alterations are certainly possible to achieve this purpose.

Sign stand (10) can be compacted for ease of transportation. As mentioned earlier, the hinging first stabilizing means (12) to upright support (11) allows for compaction. Similarly, T-tube (14) may be disengaged from upright support (11) to further enhance compactibility. This is desirable since it may be necessary for many of these signs to be transported on a single vehicle with limited space. Also, because assembly and disassembly is usually performed by a small road crew, the ease with which the present invention may be assembled and disassembled is very important. Horizontal stabilizing means (13) is preferably detachable at T-tube (14) so that it may be positioned on the base surface as securely and as safely as possible before adding upright support (11). Once horizontal stabilizing means (13) is positioned, upright support (11) is easily attached and first stabilizing means (12) is appropriately adjusted and secured given the circumstances at the time. At this point sandbags may be added to footpads (20*a* and 20*b*) and the sign finally positioned onto sign stand (10). After engaging the top and bottom of the sign with sign engaging pockets (16*a* and 16*b*) the display height of the sign may be adjusted.

The present invention complies easily with any regulations or criteria established by the federal government and various state and local governments, as well as the "standards of operation and use" set by other organizations or groups. Surprisingly, a problem in the field is that a number of these regulations and standards are not being followed, possibly in order to provide a more economical sign stand. Persons skilled in the art may have appreciated that a problem existed, but the problem was unseen by them. Others skilled in the art may have decided to cope with the difficulties of this problem. The inventor of the present invention has incorporated many safety features into his design which meet the criteria and standards necessary, without needlessly compromising the safety of the persons these signs are designed to protect.

A general safety feature of the present invention is its ability to be placed in close proximity to a roadway while remaining entirely off of the roadway. The need for just such an application can occur when a guardrail (or barrier of most any type) is positioned at the edge of a roadway because of a steep adjacent terrain. Sign stand (10) may be assembled in a fashion very similar to the mode shown in FIG. 1 so that it essentially straddles the guardrail, with first stabilizing means (12) anchored to the sloping terrain. Because horizontal stabilizing means (13) runs approximately parallel to the roadway it will remain off of the roadway, even when fully extended.

Of course one of the purposes of the present invention is to effectively warn traffic of impending hazards, without itself becoming a greater hazard. In the event, however, that sign stand (10) is struck by a motor vehicle it is preferably designed, in this embodiment, with a break-away joint (35), shown in FIG. 1. Break-away joint (35) may be positioned so that it allows upright support (11) to swing upwardly passing over the contacting vehicle, or it may be positioned to allow support (11) to lay flat on the ground when contacted. The advantages to this feature are widely known by those skilled in the art. Damage is reduced to sign stand (10), the contacting vehicle, and other nearby property or persons.

Another integral safety feature of the present invention relates to the safety of road crew members that are responsible for the erection of roadway safety signs. As mentioned earlier, it is preferable to these embodiments that first stabilizing means (12) be hinged to upright support (11). Frequently hands can be pinched or even severely injured when caught between two conventionally hinged members. With the present invention, as shown in FIG. 6, hinge (25) is extended from upright support (11) in a fashion such that a gap large enough for an adult hand to slip in and out of is created when hinge (25) is closed. The result may be fewer injuries to road crew members in general, and specifically with respect to hand injuries precipitated during the erection of sign stands.

Still another safety feature of the present invention is a means for attaching additional warning systems, such as warning lights or reflectors, or 3-flag warning system (32) as shown in FIG. 1. These systems are typically used at night, or when danger is especially imminent to traffic or road crew members. An attachment can, of course be provided at the top of upright support (11) for secure retention of these supplemental warning systems.

The foregoing discussion and the claims which follow describe the preferred embodiment of the present invention. Particularly with respect to the claims, it should be understood that changes may be made to the invention without departing from its essence. In this regard it is intended that such changes will still fall within the scope of the present invention. It simply is not practical to describe and claim all possible revisions to the present invention which may be accomplished. To the extent such revisions utilize the essence of the present invention, each would naturally fall within the breadth of protection encompassed by this patent.

I claim:

1. A portable apparatus for supporting a roadway safety sign comprising:
   a. a single upright support having an upper and a lower portion;
   b. a means for retaining a sign at a height and in a readable position, said means attached to said single upright support;
   c. a first stabilizing means originating at a connection point on said single upright support and extending laterally a distance, and wherein said first stabilizing means is telescopically extensible; and
   d. a horizontal stabilizing means having a longitudinal axis, and attached to said lower portion of said single upright support, and wherein said horizontal stabilizing means is capable of rotating about said longitudinal axis.

2. A portable apparatus for supporting a roadway safety sign as described in claim 1 wherein said horizontal stabilizing means comprises a round tube rotatably attached to said lower portion of said single upright support, and wherein said tube has a lateral extension means.

3. A portable apparatus for supporting a roadway safety sign as described in claim 2 and further comprising a means for adjusting said apparatus to a sloping base surface.

4. A portable apparatus for supporting a roadway safety sign as described in claim 3 and further comprising a means for anchoring said first stabilizing means.

5. A portable apparatus for supporting a roadway safety sign as described in claim 4 wherein said means for anchoring comprises a means for retaining weights on said first stabilizing means.

6. A portable apparatus for supporting a roadway safety sign as described in claim 5 wherein both said stabilizing means have ends and wherein said means for retaining weights comprises footpads attached to said ends.

7. A portable apparatus for supporting a roadway safety sign as described in claim 6 wherein said footpad on said first stabilizing means comprises at least one integral spike for securing to a base surface.

8. A portable apparatus for supporting a roadway safety sign as described in claim 4 wherein said means for anchoring comprises at least one integral spike for inserting into a base surface.

9. A portable apparatus for supporting a roadway safety sign as described in claim 4 and further comprising a means for increasing stability.

10. A portable apparatus for supporting a roadway safety sign as described in claim 9 wherein said horizontal stabilizing means comprises telescopically extensible left and right portions.

11. A portable apparatus for supporting a roadway safety sign as described in claim 10 wherein each said telescopically extensible means is independently extendable a distance included in the range 0–400% of the original length of each said portion.

12. A portable apparatus for supporting a roadway safety sign as described in claim 9 and further comprising an integral means for distributing the weight of the sign to avoid depression damage.

13. A portable apparatus for supporting a roadway safety sign as described in claim 12 wherein said integral means for distributing the weight of the sign comprises footpads attached to the ends of said stabilizing means.

14. A portable apparatus for supporting a roadway safety sign as described in claim 2 wherein said horizontal stabilizing means comprises telescopically extensible left and right portions.

15. A portable apparatus for supporting a roadway safety sign as described in claim 14 wherein each said telescopically extensible means is independently extendable a distance included in the range 0–400% of the original length of each said portion.

16. A portable apparatus for supporting a roadway safety sign as described in claim 15 and further comprising a means for conforming to an uneven base surface.

17. A portable apparatus for supporting a roadway safety sign as described in claim 18 and further comprising a means for adjusting the retaining position height of a sign.

18. A portable apparatus for supporting a roadway safety sign as described in claim 17 wherein said means for adjusting the retaining position height comprises a telescopically extensible upright support with a plurality of separate sections, and wherein said sections have a square cross-section.

19. A portable apparatus for supporting a roadway safety sign as described in claim 17 and further comprising a means for adjusting to variable sign types.

20. A portable apparatus for supporting a roadway safety sign as described in claim 19 wherein said means for retaining comprises at least two sign engaging pockets and wherein said means for adjusting to variable sign types comprises notches in said sign engaging pockets.

21. A portable apparatus for supporting a roadway safety sign as described in claim 17 and further comprising a means for adjusting to variable sign sizes.

22. A portable apparatus for supporting a roadway safety sign as described in claim 21 wherein said means for adjusting to variable sign sizes comprises at least two sign engaging pockets, each attached to a separate section of said telescopically extensible upright support.

23. A portable apparatus for supporting a roadway safety sign as described in claim 17 and further comprising a means for attaching additional warning systems.

24. A portable apparatus for supporting a roadway safety sign as described in claim 17 wherein said sign is erected by a person and said apparatus further comprises a means for avoiding injury to said person's hands.

25. A portable apparatus for supporting a roadway safety sign as described in claim 24 wherein said means for avoiding injury comprises a wide hinge connecting said first stabilizing means to said upright support.

26. A portable apparatus for supporting a roadway safety sign as described in claim 17 and further comprising a means for compacting.

27. A portable apparatus for supporting a roadway safety sign as described in claim 26 and further comprising a means for said single upright support to become parallel to a base surface when said support is contacted at a predetermined force, wherein said means comprises a break-away joint between said support and said stabilizing means.

* * * * *